US010871329B2

(12) United States Patent
Fiterman et al.

(10) Patent No.: US 10,871,329 B2
(45) Date of Patent: Dec. 22, 2020

(54) WIND GUIDING VANE APPARATUS

(71) Applicant: Ormat Technologies, Inc., Reno, NV (US)

(72) Inventors: Anton Fiterman, Moshav Shani (IL); Dvir Mendler, Tel Aviv (IL)

(73) Assignee: Ormat Technologies, Inc., Reno, NV (US)

( * ) Notice: Subject to any disclaimer, the term of this patent is extended or adjusted under 35 U.S.C. 154(b) by 80 days.

(21) Appl. No.: 15/925,177

(22) Filed: Mar. 19, 2018

(65) Prior Publication Data

US 2019/0285347 A1 Sep. 19, 2019

(51) Int. Cl.
*F28B 9/00* (2006.01)
*F28B 1/06* (2006.01)

(52) U.S. Cl.
CPC . *F28B 9/00* (2013.01); *F28B 1/06* (2013.01)

(58) Field of Classification Search
CPC .... F28B 9/00; F28B 1/06; F28F 13/06; F25B 39/04
See application file for complete search history.

(56) References Cited

U.S. PATENT DOCUMENTS 8,302,670 B2 * 11/2012 Yang ..... F28F 13/06 165/67
8,997,828 B2 * 4/2015 Melhuish ..... F28B 11/00 160/243
9,587,842 B2 * 3/2017 Bronicki ..... F28F 13/12
9,689,630 B2 * 6/2017 Bronicki ..... F28F 27/00
2012/0118513 A1 * 5/2012 Melhuish ..... F28B 11/00 160/5

(Continued)

FOREIGN PATENT DOCUMENTS

CN 1858536 A * 11/2006
CN 202074846 U 12/2011

(Continued)

OTHER PUBLICATIONS

PCT International Search Report dated Aug. 26, 2019 in PCT/IB2019/052171, 2 pages.

(Continued)

*Primary Examiner* — Jon T. Schermerhorn, Jr.
(74) *Attorney, Agent, or Firm* — Oblon, McClelland, Maier & Neustadt, L.L.P.

(57) ABSTRACT

The present invention provides wind guiding vane apparatus for mitigating a detrimental influence of cross winds flowing in the vicinity of an air-cooled condenser (ACC) and through one or more fans, positioned in lateral direction of the ACC, to which ambient air is directed and discharged to the atmosphere after cooling condenser tubes of the ACC, comprising one or more stationary wind guiding vanes positioned along at least a portion of an air flow streamline and below a plurality of condenser tubes of the ACC, wherein said one or more wind guiding vanes are configured to redirect air flow during windy conditions towards a portion of said plurality of condenser tubes and at least one of the fans at such an angle that significantly deviates from perpendicular, fairly horizontal inflow. The one or more wind guiding vanes are also suitable to maintain a nominal flow rate of air during quiescent wind conditions.

9 Claims, 7 Drawing Sheets

(56) References Cited

U.S. PATENT DOCUMENTS

| | | | | |
|---|---|---|---|---|
| 2015/0034276 | A1* | 2/2015 | Bronicki | F28F 13/12 165/96 |
| 2015/0096736 | A1* | 4/2015 | Bronicki | F28F 27/00 165/288 |

FOREIGN PATENT DOCUMENTS

| | | | |
|---|---|---|---|
| CN | 205156661 | U | 4/2016 |
| CN | 105928378 | A * | 9/2016 |

OTHER PUBLICATIONS

PCT Written Opinion dated Aug. 26, 2019 in PCT/IB2019/052171, 6 pages.

* cited by examiner

WIND GUIDING VANE APPARATUS

FIELD

The present invention relates to the field of air-cooled condensers, generally for use in conjunction with a power plant. More particularly, the invention relates to wind guiding vane apparatus configured to improve operation of an air-cooled condenser.

BACKGROUND

Condensers are used in power plants to condense the motive fluid exhausted from turbines. They are also used in refrigeration plants to condense refrigeration vapors such as ammonia or fluorinated hydrocarbons and in the petroleum and chemical industries such as for use in a fuel distillation apparatus to condense a variety of chemical vapors.

Air-cooled condensers (ACCs) are used in those geographical regions where cooling water for reducing the temperature of heat depleted vapor is scarce. In ACCs, heat is rejected from the hot fluid that flows through the tubes to the ambient air by passive or forced air flow, generally in counterflow by means of a fan, on the external side of the heat exchanger tubes. Axial fans often having a diameter of greater than 10 ft, e.g. 26-36 ft, are often installed above the ACC tube bundles to induce air across the bundles. In addition to the plentiful nature of air serving as the condensing medium, an additional advantage of an ACC is that air will not freeze as opposed to water. The inherently low heat transfer coefficient is compensated for by high fin areas.

The thermal performance of ACCs during windy periods, however, is reduced due to cross winds, as a result of a decreased flow of air through the fans, causing turn a decreased cooling capacity. In addition, ACC performance can also be degraded due to the recirculation of warm outlet air that is mixed with ambient air, resulting in increased air inlet temperature and in increased turbine back pressure.

One prior art method to reduce the influence of cross winds and of air recirculation involves the use of porous wind screens. These wind screens are expensive to manufacture and install, and usually involve a reduction in static pressure underneath the ACC structure.

Another method involves positioning the ACC so that the long edge of the ACC structure is parallel to the prevailing wind direction. However, such ACC positioning is often infeasible due to topographical constraints.

U.S. Pat. Nos. 9,587,842, 9,651,269 and 9,689,630, the disclosure of which are incorporated by reference, disclose wind guiding vanes or deflectors that are mounted for rotation about a vertical axis, so that their pivot angle or height is changeable in response to sensor readings. The need for controlling displacement of the wind guiding vanes or deflectors unduly adds costs to the system.

It is an object of the present invention to provide stationary wind guiding vane apparatus for increasing the thermal performance of ACCs during windy periods.

Other objects and advantages of the invention will become apparent as the description proceeds.

SUMMARY

The present invention provides wind guiding vane apparatus for mitigating a detrimental influence of cross winds flowing in the vicinity of an air-cooled condenser (ACC) and through one or more fans, positioned in lateral direction of the ACC, to which ambient air is directed and discharged to the atmosphere after cooling condenser tubes of said ACC, comprising one or more stationary wind guiding vanes positioned along at least a portion of an air flow streamline and below a plurality of condenser tubes of said ACC, wherein said one or more wind guiding vanes are configured to redirect air flow during windy conditions towards a portion of said plurality of condenser tubes and at least one of said fans at such an angle that significantly deviates from perpendicular, fairly horizontal inflow.

The one or more wind guiding vanes are also suitable to maintain a nominal flow rate of air during quiescent wind conditions.

DETAILED DESCRIPTION

Figure 1:
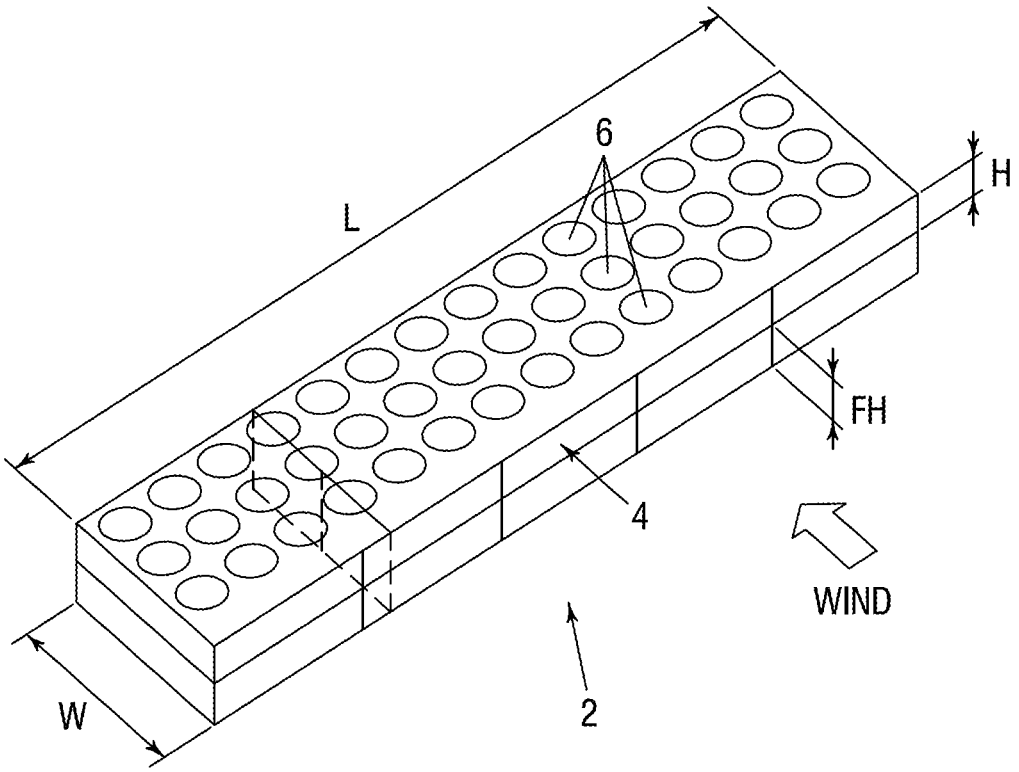
FIG. 1 is a perspective view from the top of an ACC.

Some geothermal resources and fluids desired to be exploited have such a low energy content, for example extracted at a temperature of 260-280° F., that a power plant utilizing a motive fluid, to which heat is transferred from the geothermal resource, is economically viable particularly when the turbine discharge is condensed by an air-cooled condenser (ACC). As described above, the thermal efficiency of an ACC is dependent upon the performance of the ACC fans through which ambient air is directed and discharged to the atmosphere, after cooling the motive fluid present in the condenser tubes.

During windy conditions, however, according to one explanation, perpendicular inflow to the ACC causes the dynamic pressure below the ACC to increase, and the static pressure which is reflective of resistance to airflow decreases. The differential static pressure between the inlet and outlet of the ACC fans increases, and the mean velocity of air exiting the ACC fans is consequently caused to decrease, and at times can even decrease to stalled conditions, resulting in a decreased cooling capacity and a reduced effective heat exchange area used due to a reduced flow rate of air across the condenser tubes. Under such conditions, the ACC fans find it difficult to perform at nominal conditions and their air intake drops. As a consequence of this, the air velocity under the upstream portion of the ACC structure is low so that the performance, i.e. the outlet air flow rate of the upstream fan, as well as, to some extent, the second upstream fan is reduced. Use of the wind guiding vanes, described herein, positioned, in accordance with the present invention, beneath the ACC structure and advantageously, under the first upstream fan, causes a lesser reduction in the performance of the first two upstream fans. The economic viability of an ACC-based power plant is therefore dependent upon the reliable reduction of the influence of cross winds or winds having a component in the cross wind direction, so that cooling air will reliably flow across the condenser tubes prior to being discharged through an ACC fan even during windy conditions.

The apparatus of the present invention is advantageously able to mitigate the detrimental influence of cross winds by carefully positioning one or more stationary wind guiding vanes along at least a portion of an air flow streamline, below the ACC structure. The windy air flow, after contacting the wind guiding vanes, is redirected towards the condenser tubes and fans at such an angle that significantly deviates from the perpendicular, fairly horizontal inflow. The wind guiding vanes are also suitable to maintain a nominal flow rate during quiescent wind conditions.

The actual location of the wind guiding vanes along the streamlines, as well as their size and orientation, have been determined with use of computational fluid dynamics (CFD) analysis, based on a numerical Navier-Stokes equation solution to model the general air flow in and around the ACC structure, together with shear stress transport (SST) turbulence model to evaluate the turbulent flow in the boundary layer of air within the ACC structure, near the wind guiding vanes, finned tubes and ACC fans.

Reference is first made to FIG. 1, which schematically illustrates an ACC designated ACC 2, typically located outdoors. ACC 2 comprises condenser tube section 4, each of which may be finned, and a plurality of fans 6. Usually three fans are used, while sometimes two or even more fans, located in the lateral or width direction W of ACC 2, can be used. The spaced tubes through which motive fluid to be condensed flows are arranged so that cooling air can flow over the tubes and dissipate the thermal energy of the motive fluid flowing therein. ACC 2 is generally arranged as a rectangular array with a length L, width W and height H. ACC 2 is typically installed above the level of ground at a distance FH from the ground to allow free flow of air underneath the ACC. In order to increase the rate of heat dissipation, fans 6 are installed above tube section 4 to induce the flow of air from the area beneath ACC 2 up through tube section 4. In addition, such an arrangement reduces to a large extent the possible recirculation of air exiting the fans being drawn into the inlet flow of air under ACC 2.

The efficiency of heat dissipation of ACC 2 depends on various ambient conditions, such as the amount of exposure to direct sun light, the ambient temperature and the actual wind conditions (direction and magnitude) at the given location of ACC 2. For large ACCs with a high aspect ratio (L/W) figure, wind blowing parallel to its length dimension has a negligible effect. In contrast, wind blowing parallel to it width dimension has a substantial effect due to the perpendicular inflow.

Figure 2:
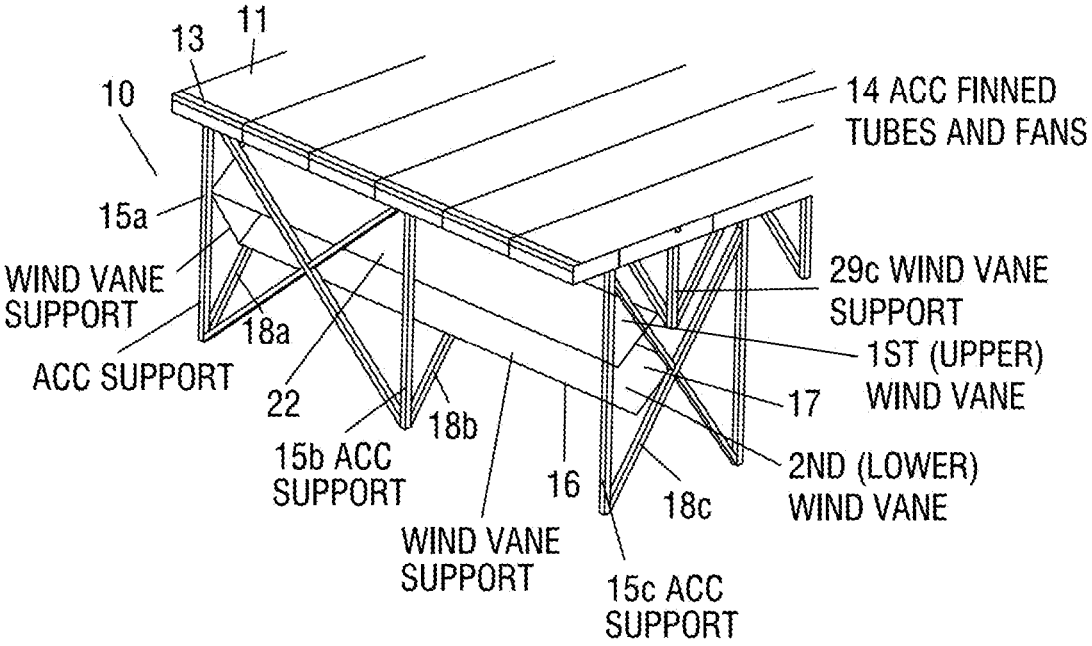
FIG. 2 is a perspective view from one longitudinal end of wind guiding vane apparatus, according to ore embodiment of the present invention.

FIG. 2 illustrates wind guiding vane apparatus 10, according to one embodiment of the present invention. Wind guiding vane apparatus 10 comprises two vertically spaced, elongated and stationary wind guiding vanes 22 and 23 that are fixed in place below one lateral end 11 of the schematically illustrated ACC 14, i.e. the condenser tube section for condensing the motive fluid, such as organic motive fluid, present in the finned tubes. The wind guiding vanes are preferably straight to reduce their cost by virtue of the relative ease, in manufacturing, but curved wind guiding vanes are also in the scope of the invention, wind guiding vanes 22 and 23 are generally inclined with respect to horizontal support elements 13 in the vicinity of lateral end 11, such that the downstream edge 17 of each wind guiding vane is located at a greater height than the corresponding upstream edge 16 thereof, to ensure that wind-derived air flow will be redirected thereby towards the condenser tubes and fans at an angle that significantly deviates from perpendicular, fairly horizontal inflow. The wind guiding vanes are sufficiently sturdy to withstand the relatively high forces associated with the kinetic energy in high-velocity wind, and are made for example from stainless steel to resist corrosion when exposed to precipitation.

The upstream edge 16 of upper wind guiding vane 22 may be connected to three spaced columns 15A-15C, spaced in the longitudinal direction, adapted to support the underside of ACC 14. The downstream edge 17 of upper wind guiding vane 22 may be connected to braced wind guiding vane support structure 27A-27C. The downstream edge 17 of lower wind guiding vane 23 may be connected to each brace 18A-18C extending upwardly from the bottom of a corresponding column 15A-15C to a top region of a corresponding intermediate column 27A-27C. The upstream edge 16 of lower wind guiding vane 23 may be connected to an additional support, structure, for example one connected to upper wind guiding vane 22.

In this fashion, the support structures sufficiently immobilize wind guiding vanes 22 and 23 without appreciably interfering with the wind-derived air flow in the vicinity of the wind guiding vanes.

Although ACC 14 is shown to be configured as a rectangular array, it will be appreciated that the ACC may be configured in other ways as well.

Figure 3:
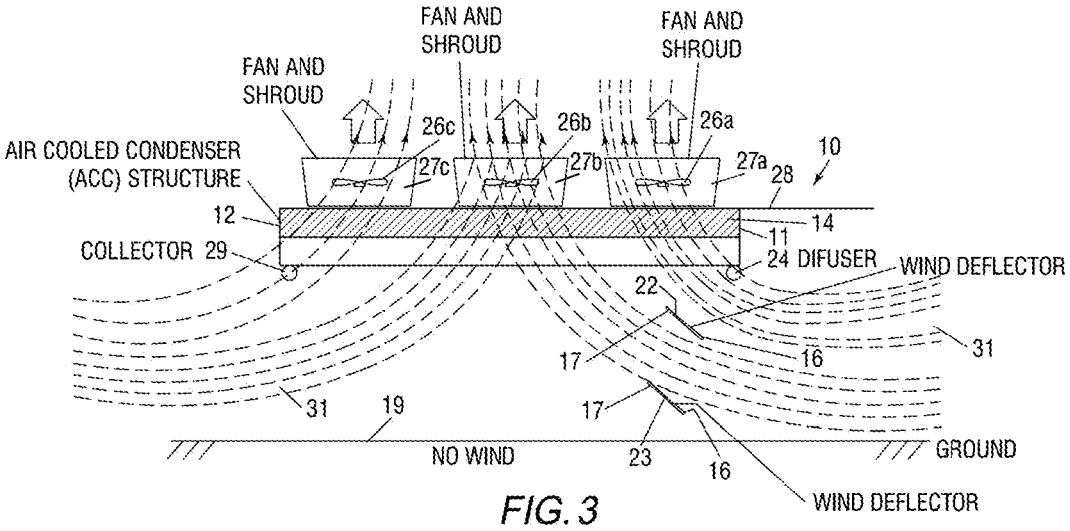
FIG. 3 is a side view from one longitudinal end of wind guiding vane apparatus, according to one embodiment of the present invention, showing air flow during quiescent conditions.
Figure 4:
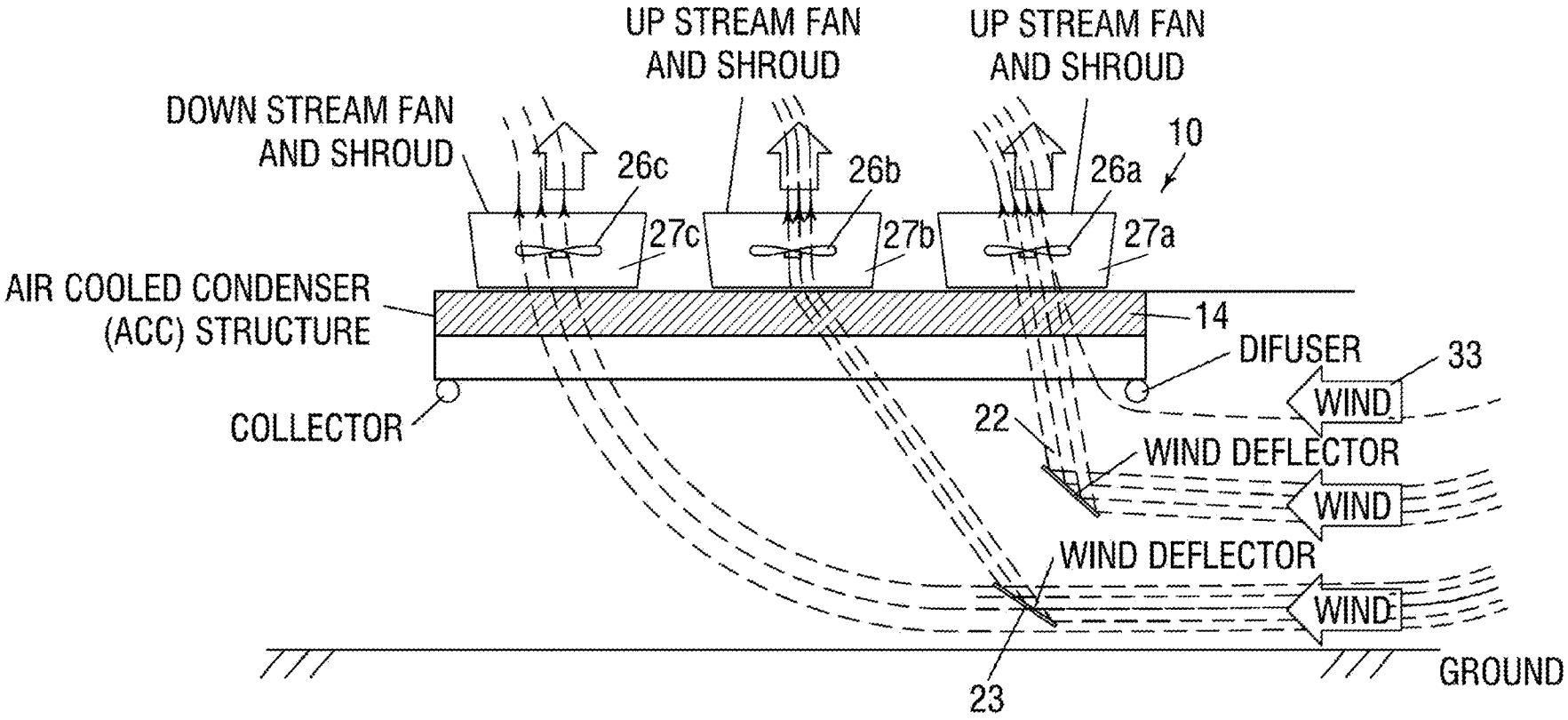
FIG. 4 is a side view from one longitudinal end of the apparatus of FIG. 3, showing air flow during windy conditions.

FIGS. 3 and 4 schematically illustrate the utility of the wind guiding vanes to adequately direct an air flow to the condenser tubes and to the ACC fans during both quiescent conditions and windy conditions. As referred to herein, windy conditions are considered to be those environmental conditions that induce the speed of winds to be greater than 5 m/s, for example between 5-10 m/s. Such windy conditions may occur on a seasonal basis, such as during continued periods in the summer season, or even during a shortened period, such as one hour or a period of six hours. Even so, the wind guiding vanes described herein also bring about an improvement of performance of the first two fans even when winds of about 3 m/s prevail.

The vertical cross section of wind guiding vane apparatus 10 illustrates a unit of three laterally or width spaced fans 26A-C, each of which surrounded by a corresponding shroud 27A-27C. Fans 26A-C, usually of the axial type but which may be configured in other ways as well, are supported by fan deck 28 located above ACC 14, so as to be in fluid communication with a corresponding region of ACC 14 in order to induce the flow of air across the condenser tubes. Alternatively, a forced-draft arrangement can also be used.

Vertically spaced wind guiding vanes 22 and 23 are positioned below ACC 14, and are inclined with respect to, and located above, underlying ground surface 19. The inclination of wind guiding vanes 22 and 23 is arranged such that their downstream edge 17 is inclined upwards towards the direction of second lateral end 12 of ACC 14 and away from first lateral end 11 thereof. Wind guiding vanes 22 and 23 may be connected to a support structure as illustrated in FIG. 2, or may be connected in other ways to wind guiding vane apparatus 10. Wind guiding vanes 22 and 23 may be positioned directly below the first upstream fan 26A, to achieve more direct control of the wind-derived air flow towards the condenser tubes and ACC fans.

Apparatus 10 is shown to include in one embodiment a diffuser 24 for receiving organic motive fluid vapor from the outlet of an organic vapor turbine and supplying it to the internal volume of the condenser tubes of ACC 14. Apparatus 10 also comprises collector 29 for collecting liquid organic motive fluid condensate produced by ACC 14, to supply the same by a steady and continuous flow to the inlet of the cycle pump.

FIG. 3 illustrates the air flow during quiescent conditions to fans 26A-26C, and FIG. 4 illustrates the air flow during windy conditions. Fans 26A-26B are considered as upstream fans as their operation is affected by the wind guiding vane-influenced, wind-derived air flow, while fan 26C is considered as a downstream fan as its operation is to a large extent unaffected by the wind guiding vane-influenced, wind-derived air flow.

It will be appreciated that wind guiding vane apparatus 10 may comprise additional fans, longitudinally and/or laterally or width spaced from the fan unit of fans 26A-26C, e.g. 2 laterally adjacent ACC structures, and in fluid communication with a corresponding region of ACC 14, whether by repeating the sequence of fans 26A-26C or by providing any other desired sequence, depending on the amount of heat to be dissipated. The number of fan units, present in the longitudinal direction L of ACC 2 (see FIG. 1), may vary from e.g. 7-8 to 20-24, depending also, on the type of motive fluid used.

As shown in FIG. 3, air flow 31 during quiescent wind conditions is equally drawn into each of the fans 26A-26C, and from all directions. Wind guiding vanes 22 and 23 do not disturb air flow 31 as far as operation of ACC 14 is concerned, while flowing across the condenser tubes towards fans 26A-26C, because the wind guiding vanes are positioned on the streamlines of air flow 31. Consequently, the nominal power of the fans is maintained under quiescent conditions even with the presence of wind guiding vanes 22 and 23.

As shown in FIG. 4, wind guiding vanes 22 and 23 remain physically located below the first upstream fan 26A, being in the same position during windy conditions as during quiescent wind conditions. Although wind guiding vanes 22 and 23 do not disturb the air flow during quiescent wind conditions, they cause redirection of the air flow during windy conditions when the wind-derived air flow 33 blows in the direction shown in FIG. 4. Following interaction with wind guiding vanes 22 and 23, the direction of wind-derived air flow 33 is caused to change, being directed to a specific region of condenser tubes and to a specific fan, at an angle that significantly deviates from virtually horizontal inflow. Upper wind guiding vane 22 is configured to direct the air flow to the first upstream fan 26A, while lower wind guiding vane 23 influences to a greater extent the air flow to the second upstream fan 26B.

The deflection of air flow 33 provided by each of wind guiding vanes 22 and 23 is a function of the wind guiding vane inclination relative to underlying ground surface 19, the horizontal and vertical distance to an outer edge of the portion of the condenser tubes to be cooled by the redirected air flow, and the length and width of the wind guiding vane.

As to downstream fan 26C, its operation has been found to be virtually unaffected by the residual air flow flowing downstream to wind guiding vanes 22 and 23, insignificant disturbance apparently remaining in this residual air flow following the influence of wind guiding vanes 22 and 23. Consequently, a third wind guiding vane to redirect the air flow to downstream fan 26C is unnecessary. Thus, apparatus 10 achieves a cost-effective solution since only two wind guiding vanes are needed for a unit of three fans, although three, or any other number of wind guiding vanes, may also be employed.

Figure 5:
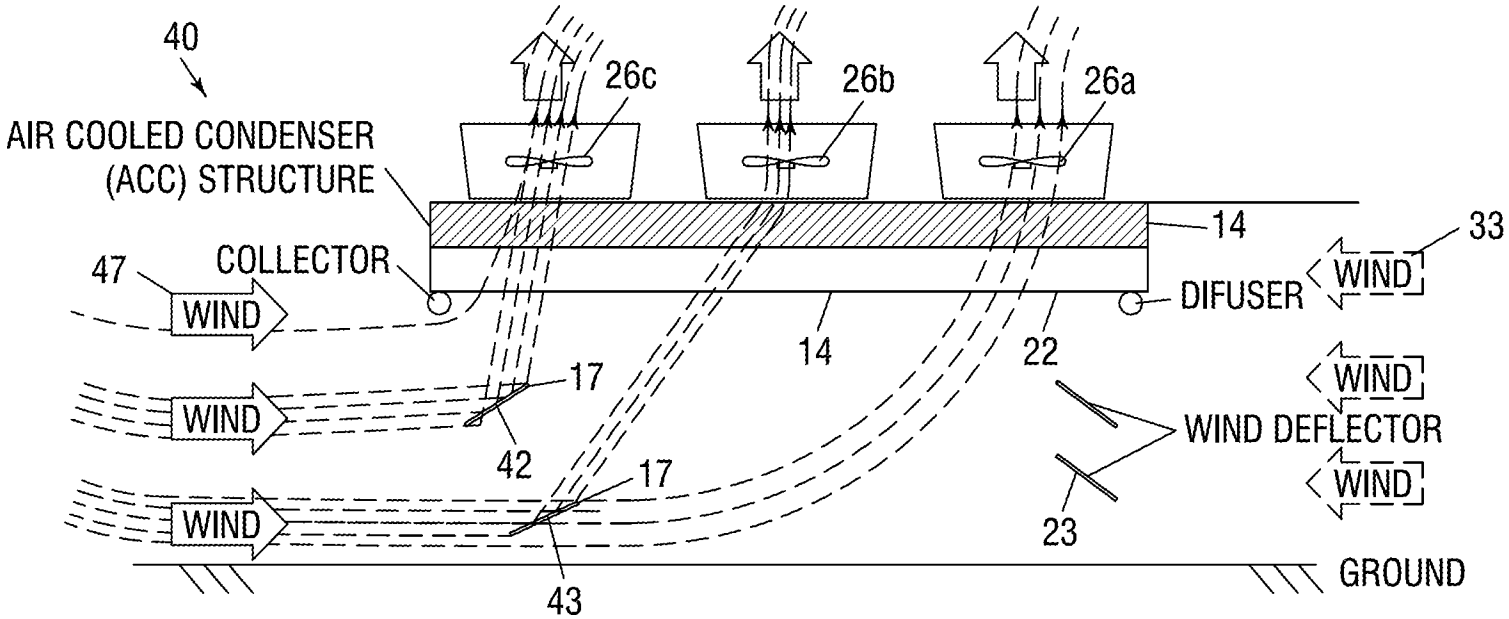
FIG. 5 is a side view from one longitudinal end of wind guiding vane apparatus, according to another embodiment of the present invention, showing air flow during windy conditions.

FIG. 5 illustrates wind guiding vane apparatus 40 for use in conjunction with environmental conditions that are characteristic of wind direction shifts, which can sometimes be sudden, such as winds that change direction with respect to a median direction to produce air flow 47 oppositely directed to air flow 33.

Apparatus 40 is identical to apparatus 10 of FIG. 4, but with the addition of wind guiding vanes 42 and 43 positioned directly beneath fan 26C, wind guiding vanes 42 and 43 may be connected to a support structure as illustrated in FIG. 2, or may be connected in other ways to wind guiding vane apparatus 40. The inclination of wind guiding vanes 42 and 43 is arranged such that their downstream edge 17 is pointing in the direction of first longitudinal end 11 of ACC 14 and away from second longitudinal end 12 thereof. In this fashion, apparatus 40 is capable of suitably redirecting air flow 33 toward fans 26A-26B, and, following a wind shift, of suitably redirecting air flow 47 toward fans 26B-26C, to further increase the thermal performance of a power plant provided with apparatus 40.

Example 1

Figure 6:
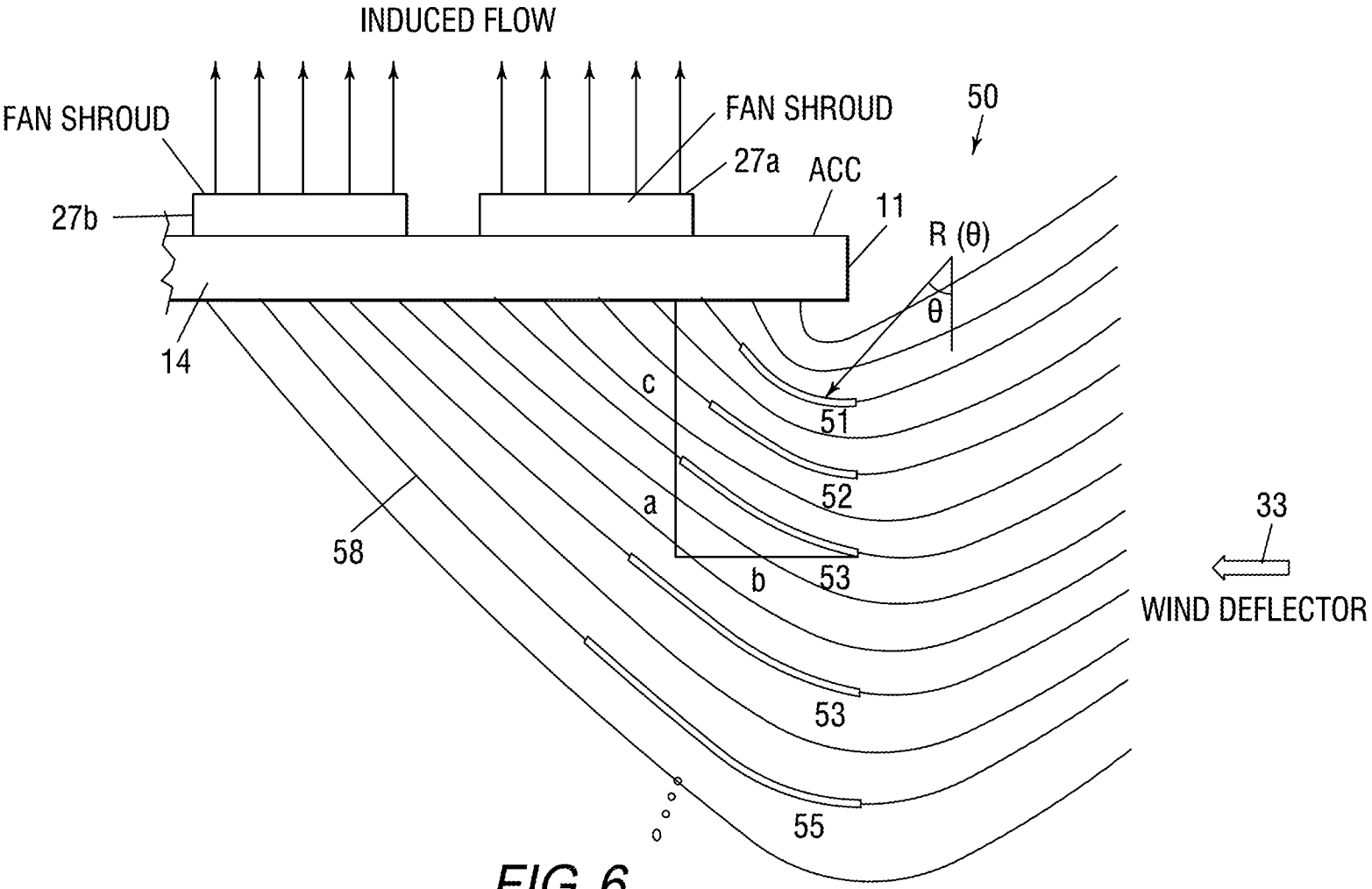
FIG. 6 schematically illustrates the generation of induced air flow streamlines during quiescent conditions.

FIG. 6 illustrates the positioning of curved wind guiding vanes 51-55 that are used to redirect the air flow 33 during windy conditions towards fan shrouds 27A and 27B of wind guiding vane apparatus 50, which are mounted above ACC 14 to produce an induced flow. Each of wind guiding vanes 51-55 is mounted one below the other, below first lateral end 11 of ACC 14, such that the projected horizontal dimension b and the distance c from the wind guiding vane to the bottom plane of AA 14 of each wind guiding vane progressively increases from the uppermost wind guiding vane 51 to the lowermost wind guiding vane 55. Dimension a is the projected vertical dimension of each wind guiding vane, dimension d is the horizontal distance of the wind guiding vane from the upstream edge of ACC 14, and R refers to the radius of each wind guiding vane.

Each of wind guiding vanes 51-55 is shown to coincide with a different streamline 58 that is produced as a result of the interaction of air flow 33 with a corresponding wind guiding vane. Wind guiding vanes 51-53 redirect air flow 33 towards the fan mounted within shroud 27A, and wind guiding vanes 54-55 redirect air flow 33 towards the fan mounted within shroud 27B.

Example 2

Figure 7:
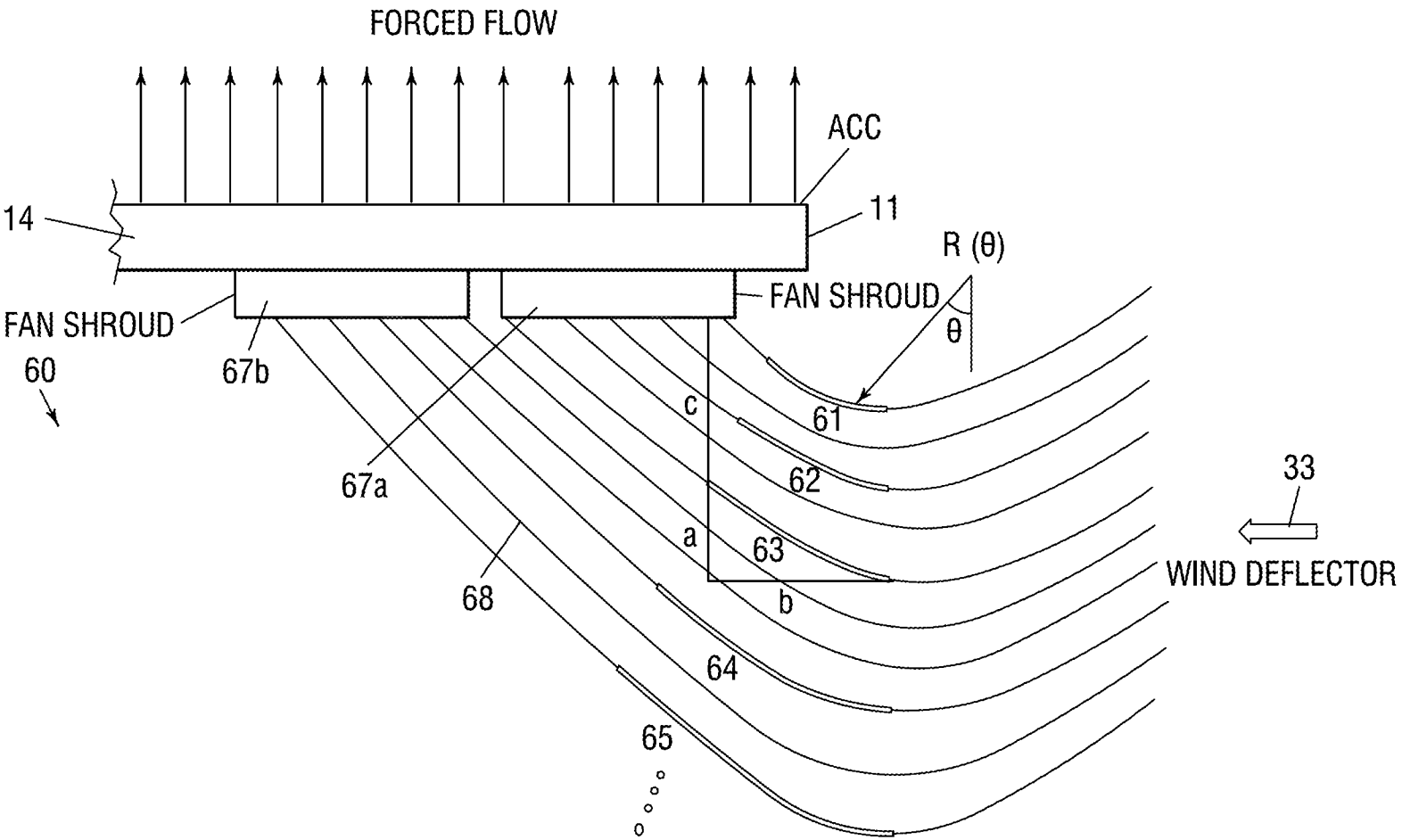
FIG. 7 schematically illustrates the generation of forced air flow streamlines during quiescent conditions.

FIG. 7 illustrates the positioning of curved wind guiding vanes 61-65 that are used to redirect the air flow 33 during windy conditions towards fan shrouds 67A and 67B of wind guiding vane apparatus 60, which are mounted below ACC 14 to produce a forced flow. Each of wind guiding vanes 61-65 is mounted one below the other, below first lateral end 11 of ACC 14, such that the projected horizontal al dimension b and the distance c from the wind guiding vane to the bottom plane of AA 14 of each wind guiding vane progressively increases from the uppermost wind guiding vane 61 to the lowermost wind guiding vane 65. Dimension a is the projected vertical dimension of each wind guiding vane, dimension d is the horizontal distance of the wind guiding vane from the upstream edge of ACC 14, and R refers to the radius of each wind guiding vane.

Each of wind guiding vanes 61-65 is shown to coincide with a different streamline 68 that is produced as a result of the interaction of air flow 33 with a corresponding wind guiding vane. Wind guiding vanes 61-63 redirect air flow 33 towards the fan mounted within shroud 67A, and wind guiding vanes 64-65 redirect air flow 33 towards the fan mounted within shroud 67B.

Example 3

A determination of the streamlines along at least a portion of which the wind guiding vanes of the present invention are positioned was based on a numerical CFD analysis together with SST turbulence model, inputting the wind conditions measured at the Don Campbell geothermal power plant located in Nevada, USA. A 10-million mesh was used to cover the ACC structure and its adjacent air flow. The size, number and location of the wind guiding vanes were designed by use of the CFD analysis, physically tested at the Don Campbell geothermal power plant, and reconfirmed by use of the CFD analysis.

The analyzed ACC structure was a bay having a length of 60 ft and a width of 26 ft, and containing three tube bundles of finned condenser tubes. The three fans used in the ACC bay all had a diameter of 16 ft.

The air flow streamlines were calculated according to different wind speeds and predicted the decrease in air flow rate at the exit of the ACC fans during windy conditions. These predictions were verified by actual smoke tests at the Don Campbell geothermal power plant.

Furthermore, 2 wind guiding vanes physically located under the first fan of the ACC at the Don Campbell geothermal power plant in Nevada, U.S.A., were found to improve the performance of the 1$^{st}$ 2 upstream ACC fans, their performance and air flow rate at their exit being also checked by actual smoke tests and velocity measurements at the Don Campbell geothermal power plant and verified as well by the predicted numerical CFD analysis together with SST analysis performed for such wind conditions.

While some embodiments of the invention have been described by way of illustration by referring to the drawings, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A wind guiding apparatus for mitigating a detrimental influence of cross winds flowing in the vicinity of a horizontal air-cooled condenser (ACC) and through one or more fans to which ambient air is directed and discharged to the atmosphere after cooling horizontal condenser tubes of said horizontal ACC, said wind guiding apparatus comprising:

a) a plurality of support structures supporting the horizontal ACC from below and above an underlying ground surface; and b) one or more stationary wind guiding vanes located below a plurality of horizontal condenser tubes of the horizontal ACC, each of said wind guiding vanes connected to, and immobilized by, one or more of said support structures, wherein said one or more support structures is configured to position each of said wind guiding vanes connected thereby at a linear and angular position relative to one or more fans of the horizontal ACC, such that each of said wind guiding vanes is (1) positioned on, without disturbing, a fan-derived air flow streamline flowing to a corresponding fan of the horizontal ACC during no wind conditions and during operation of the one or more fans of the horizontal ACC and (2) coincident with at least a portion of a wind-derived air flow streamline produced during windy conditions, wherein said one or more wind guiding vanes are configured to redirect the air flow during windy conditions towards a portion of said plurality of horizontal condenser tubes and at least one of said fans at such an angle that deviates from perpendicular, fairly horizontal inflow, wherein the one or more stationary wind guiding vanes comprises exactly two vertically spaced and elongated wind guiding vanes that are fixed in place below a same longitudinal end of the horizontal ACC, wherein the two wind guiding vanes are inclined with respect to an underlying ground surface, such that a downstream edge of each wind guiding vanes is located at a greater height than a corresponding upstream edge thereof and is pointing towards a second lateral end of the horizontal ACC and away from a first lateral end thereof, and wherein the two wind guiding vanes are both positioned directly below a same first upstream fan.

2. The apparatus according to claim 1, further comprising two additional vertically spaced and elongated wind guiding vanes connected to, and immobilized by, one or more of the support structures and that are fixed in place below a same longitudinal end of the horizontal ACC and are laterally spaced from the two wind guiding vanes, wherein the two additional wind guiding vanes are inclined with respect to the underlying ground surface, such that a downstream edge of each of said two additional wind guiding vanes is located at a greater height than a corresponding upstream edge thereof and is pointing towards the first lateral end of the horizontal ACC and away from the second lateral end of the horizontal ACC, to redirect the air flow following a wind shift, wherein the one or more support structures is configured to position each of said additional wind guiding vanes connected thereby at a linear and angular position relative to the one or more fans of the horizontal ACC, such that each of said additional wind guiding vanes is (1) positioned on, without disturbing, a fan-derived air flow streamline flowing to a corresponding fan of the horizontal ACC during no wind conditions and during operation of the one or more fans of the horizontal ACC and (2) coincident with at least a portion of a wind-derived air flow streamline produced during windy conditions.

3. The apparatus according to claim 1, wherein the one or more support structures comprises a plurality of laterally spaced columns to each of which an edge of at least one of the one or more stationary wind guiding vanes is connected.

4. The apparatus according to claim 3, wherein the one or more support structures comprises a plurality of braces to each of which an edge of at least one of the one or more stationary wind guiding vanes is connected, each of said braces extending from a bottom region of one of the columns to an upper region of a corresponding intermediate column longitudinally spaced from said one column.

5. The apparatus according to claim 1, wherein each of the one or more wind guiding vanes has a same slope as the slope of the fan-derived air flow streamline on which it is positioned, at a wind guiding vane region which is tangent to the fan-derived air flow streamline during no wind conditions.

6. The apparatus according to claim 5, wherein the one or more stationary wind guiding vanes are planar.

7. The apparatus according to claim 5, wherein the one or more stationary wind guiding vanes are curved and mounted one below the other such that a projected horizontal dimension and a distance to a bottom plane of the horizontal ACC of each of the curved wind guiding vanes progressively increases from an uppermost wind guiding vane to a lowermost wind guiding vane.

8. A method for mitigating a detrimental influence of cross winds flowing in the vicinity of a horizontal air-cooled condenser (ACC) and through one or more fans to which ambient air is directed and discharged to the atmosphere after cooling horizontal condenser tubes of said horizontal ACC, comprising:

a) providing a plurality of support structures supporting the horizontal ACC from below and above an underlying ground surface; and b) providing one or more stationary wind guiding vanes located below a plurality of condenser tubes of the horizontal ACC, each of said wind guiding vanes connected to, and immobilized by, one or more of said support structures, wherein said one or more support structures is configured to position each of said wind guiding vanes connected thereby at a linear and angular position relative to one or more fans of the horizontal ACC, such that each of said wind guiding vanes is (1) positioned on, without disturbing, a fan-derived air flow streamline flowing to a corresponding fan of the horizontal ACC during no wind conditions and during operation of the one or more fans of the horizontal ACC and (2) coincident with at least a portion of a wind-derived air flow streamline produced during windy conditions, wherein said one or more wind guiding vanes are configured to redirect the air flow during windy conditions towards a portion of said plurality of horizontal condenser tubes and at least one of said fans at such an angle that deviates from perpendicular, fairly horizontal inflow, wherein the one or more stationary wind guiding vanes comprises exactly two vertically spaced and elongated wind guiding vanes that are fixed in place below a same longitudinal end of the horizontal ACC, wherein the two wind guiding vanes are inclined with respect to an underlying ground surface, such that a downstream edge of each wind guiding vanes is located at a greater height than a corresponding upstream edge thereof and is pointing towards a second lateral end of the horizontal ACC and away from a first lateral end thereof, and wherein the two wind guiding vanes are both positioned directly below a same first upstream fan.

9. A wind guiding apparatus for mitigating a detrimental influence of cross winds flowing in the vicinity of an air-cooled condenser (ACC) and through one or more fans to which ambient air is directed and discharged to the atmosphere after cooling condenser tubes of said ACC, said wind guiding apparatus comprising:

a) a plurality of support structures supporting the ACC from below and above an underlying ground surface; and b) one or more stationary wind guiding vanes located below a plurality of condenser tubes of the ACC, each of said wind guiding vanes connected to, and immobilized by, one or more of said support structures, wherein said one or more support structures is configured to position each of said wind guiding vanes connected thereby at a linear and angular position relative to one or more fans of the ACC, such that each of said wind guiding vanes is (1) positioned on, without disturbing, a fan-derived air flow streamline flowing to a corresponding fan of the ACC during no wind conditions and during operation of the one or more fans of the ACC and (2) coincident with at least a portion of a wind-derived air flow streamline produced during windy conditions, wherein said one or more wind guiding vanes are configured to redirect the air flow during windy conditions towards a portion of said plurality of condenser tubes and at least one of said fans at such an angle that deviates from perpendicular, fairly horizontal inflow, wherein the one or more stationary wind guiding vanes comprises exactly two vertically spaced and elongated wind guiding vanes that are fixed in place below a same longitudinal end of the ACC, wherein the two wind guiding vanes are inclined with respect to an underlying ground surface, such that a downstream edge of each wind guiding vanes is located at a greater height than a corresponding upstream edge thereof and is pointing towards a second lateral end of the ACC and away from a first lateral end thereof, and wherein the two wind guiding vanes are both positioned directly below a same first upstream fan.

* * * * *